United States Patent [19]

Will et al.

[11] Patent Number: 4,891,551

[45] Date of Patent: Jan. 2, 1990

[54] FLUORESCENT LAMP WITH GROUNDED AND FUSED ELECTRODE GUARD

[75] Inventors: Jerald D. Will, Lexington, Ky.; Frank M. Latassa, Morgantown, W. Va.

[73] Assignee: North American Philips Corporation, New York, N.Y.

[21] Appl. No.: 200,382

[22] Filed: May 31, 1988

[51] Int. Cl.[4] ..... H01J 61/10

[52] U.S. Cl. ..... 313/492; 313/614; 313/240

[58] Field of Search ..... 313/492, 574, 595, 609, 313/613, 614, 239, 240

[56] References Cited

U.S. PATENT DOCUMENTS 2,938,137 5/1960 Reger et al. ..... 313/492 X

*Primary Examiner*—Kenneth Wieder

*Attorney, Agent, or Firm*—Emmanual J. Lobato

[57] ABSTRACT

A conductive link maintains the electrode of a fluorescent lamp and a conductive electrode guard at the same electrical potential to reduce lamp power dissipation. The conductive link may be a fuse wire to protect the lamp ballast from excessive current upon electrode failure and shorting to the electrode guard.

14 Claims, 2 Drawing Sheets

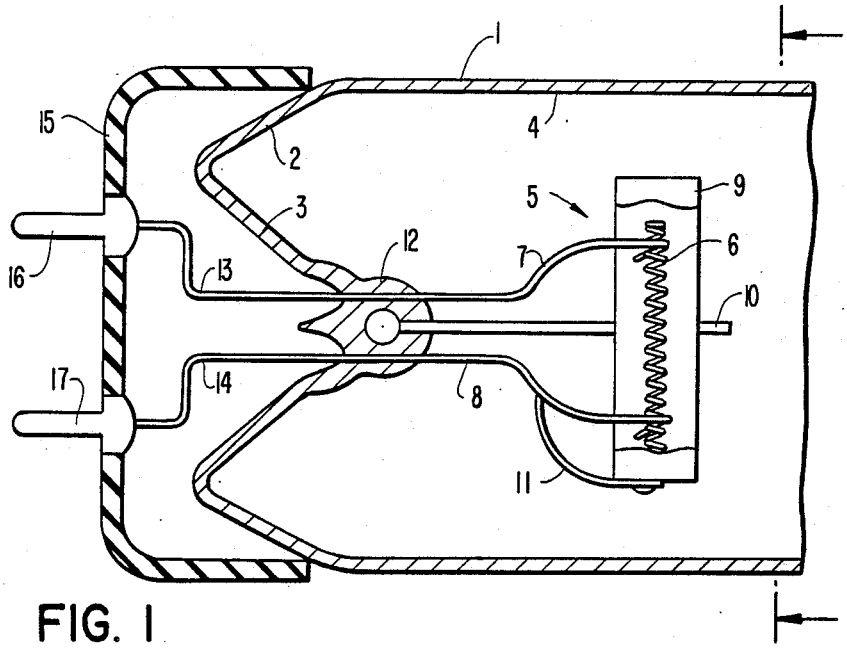
FIG. 1
FIG. 2
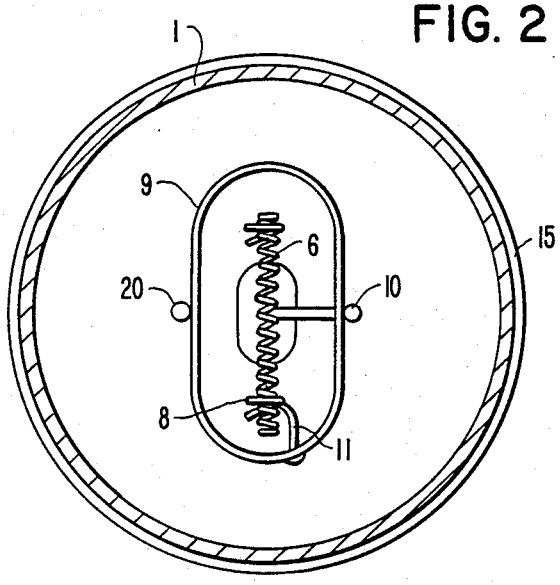

FLUORESCENT LAMP WITH GROUNDED AND FUSED ELECTRODE GUARD

BACKGROUND OF THE INVENTION

The present invention relates to fluorescent lamps having metallic electrode guards, and more particularly to a safe improvement in such lamps that reduces lamp power dissipation.

Low pressure mercury vapor discharge lamps having a phosphor layer for emitting light, commonly known as fluorescent lamps, generally have electrodes made of coiled tungsten wire. These electrodes are coated with a material for enhancing the thermionic emission of electrons. During lamp operation tungsten and emitter material can evaporate or sputter from the electrodes and be deposited in the area of the electrodes on the lamp wall in the form of tungsten and tungsten products. This deposition is evident as visible blackening and is a detrimental consequence of lamp operation.

One technique for suppressing the blackening from electrode materials is to partially surround each electrode with a guard. The guard is typically in the form of a closed ring made of a conductive metal strip and positioned surrounding the sides of the electrode. Examples of this structure are shown in U.S. Pat. Nos. 4,032,813 and 4,032,814.

In these patents the conductive metal strip carries a getter such as a mixture of zirconium and aluminum for reducing the quantity of unwanted impurity gases. Additionally, the metal strip supports a small capsule of mercury needed for normal lamp operation. Finally, the conductive metal strip reduces the lamp's energy consumption.

Both of the patents just mentioned show lamp structure in which the electrical potential of the electrode guard is floating relative to the electrode potential. This is achieved by mechanically supporting it on a mount that is electrically insulated from the supports of the electrode. The floating arrangement of the electrode guard is also mentioned in the text Fluorescent Lamps And Lighting, W. Elenbaas, ed., Sec. 5.3 (1962).

In fluorescent lamps that operate on alternating current the electrodes operate alternately as a cathode and an anode. As discussed in the text Electric Discharge Lamps, John Waymouth, Chapter 4 (MIT 1971), the alternating function of the electrodes requires compromises in the electrode design. Ideally, a fluorescent lamp anode electrode would have a large area to reduce the potential difference between the anode and the plasma within the lamp, known as the "anode fall". The large area, however, would be detrimental to cathode operation of the electrode which requires rapid heating to thermionic emitting temperatures and to avoid sputtering during glow discharge.

It would be desirable to use the prior art cathode guard as part of the electrode when the electrode is operating as an anode. This would increase the effective area of the anode and thereby reduce the anode fall; however, care would have to be taken to avoid degrading this cathode operation of the electrode.

A lamp employing an electrode shield as part of the anode is disclosed in German Democratic Republic Patentschrift No. 221,881. In that patent a cold-starting, self-heating electrode is connected to a cylindrical concentric auxiliary electrode, having the structure of a shield, through a diode. When the electrode is biased positive to operate as the anode, the diode polarity is effective to establish a conductive path between the self-heating electrode and the auxiliary electrode. Consequently, the effective electrode total area includes the auxiliary electrode area and the anode fall is reduced. When the electrode is biased negative, that is, as a cathode, the diode polarity presents a high impedance path to the auxiliary electrode which is effectively disconnected from the self-heating electrode.

It would be desirable to use the same technique in lamps with other types of electrodes. However, there are practical reasons for not doing so. If a lamp having a filament electrode has an electrode guard electrically connected to one current lead of the electrode, there is a danger that the other electrode lead might come in contact with the electrode guard. This could occur, for example, if the filament electrode broke and a piece attached to the electrode lead that is normally unconnected to the guard were to flop over and touch the guard. The consequence would be a low resistance connection across the electrode leads, rather than the normal electrode impedance, with an excessive current flow through the lamp ballast electrode heater winding. The result would be damage to the ballast.

Additionally, the use of a diode within the lamp discharge envelope presents severe quality requirements for the component. The diode must be able to withstand an intense ultraviolet flux, and elevated temperatures for the life of the lamp which may exceed 20,000 operating hours. The diode also contributes to the lamp cost and consequently the avoidance of using a diode would be advantageous.

Accordingly, it is an object of the invention to provide an electrode assembly in which an electrode guard connected to the lamp electrode can be safely utilized with filament electrodes.

It is another object of the invention to provide an electrode assembly which exhibits a reduced anode fall without the use of rectifying elements or similar components.

SUMMARY OF THE INVENTION

In a fluorescent lamp according to the invention a lamp electrode is partially surrounded by a metallic guard for shielding material ejected from the electrode. A metallic conductive link defining a conductive path free of rectifying elements is connected to establish a conductive path between the metallic guard and a conductor supplying voltage to the electrode. The metallic conductive link maintains the metallic guard substantially at the same potential as the electrode, irrespective of the polarity of the electrode voltage.

In a preferred embodiment of the invention the metallic conductive link is a fuse. The metallic conductive link consists essentially of a length of wire connected between the metallic guard or the metallic guard support and a conductor supplying voltage to the electrode. In a preferred embodiment the length of wire is 0.0035 inch diameter stainless steel wire.

In a preferred embodiment the lamp electrode is a filament electrode having respective ends connected to first and second lead-in conductors to allow application of a potential across the electrode. The potential applied across the first and second lead-in conductors causes a heating current to flow through the filament electrode. A metallic guard partially surrounds the electrode, and a metallic fuse link is connected to define a conductive path between the metallic guard and the first lead-in conductor for maintaining the metallic guard at the same potential as the first lead-in conductor during normal lamp operation. The fuse link is effective to fuse and disconnect the metallic guard from the first lead-in conductor in response to an excess current through the fuse link. The metallic fuse link is comprised of a metal wire defining a conductive path free of rectifying elements between the metallic guard and the first lead-in conductor. The metallic fuse link can be connected to the first lead-in conductor and either directly to the electrode guard or to a conductive support for the electrode guard.

BRIEF DESCRIPTION OF THE DRAWINGS

FIG. 1 is a partial section showing an electrode assembly according to the invention in a fluorescent lamp, FIG. 2 is a cross-section of the electrode assembly and lamp shown in FIG. 1.

DETAILED DESCRIPTION OF THE INVENTION

Figure 3:
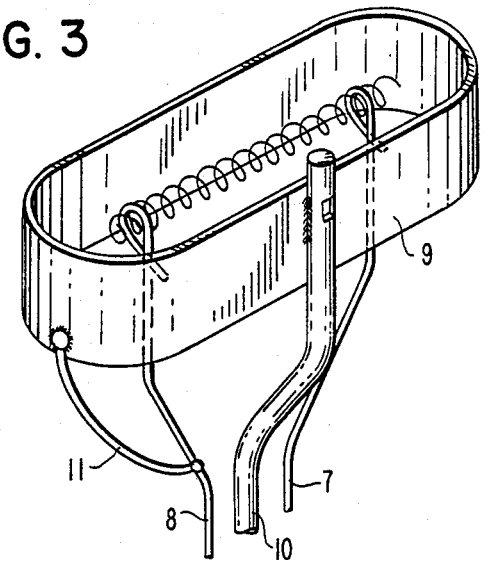
FIG. 3 is an isometric view of the electrode assembly according to the invention.

FIG. 1 illustrates an end portion, in section, of a fluorescent lamp, including the electrode assembly of the lamp. The lamp is comprised of an envelope having a tubular section 1 with a smaller diameter end 2 which is closed by a stem 3. The inner surface for the lamp envelope is coated with a fluorescent material 4 which fluoresces in response to ultraviolet radiation. Electrode assembly 5 within the lamp envelope 1 is energizable for sustaining an electrical discharge through a plasma of mercury ions within the lamp. The ions undergo recombination and emit the ultraviolet radiation which is incident on the coating of fluorescent material 4. The fluorescent material 4 fluoresces in the visible region and emits light. These aspects of the lamp are conventional.

The electrode assembly 5 is comprised of a filament electrode 6 supported by a pair of conductive lead-through and supports 7, 8. This structure permits a heater current to flow through the filament electrode 6 during lamp operation and is the type of electrode structure used with rapid-start type lamp ballasts. A short cylindrical guard 9 or shield partially surrounds the filament electrode 6 and is supported on a guard support 10.

A novel feature of the invention is the metallic conductive link 11 connected between the electrode support 8 and the electrode guard 9. The conductive link 11 is connected to the support 8 and the guard 9 so as to define a conductive path between them and maintain them at the same potential during lamp operation, i.e. the guard 9 is grounded to the electrode 6.

The stem 3 terminates at a press seal 12 in which the conductive electrode supports 7, 8 and guard support 10 are embedded. Leads 13, 14 are connected to respective ones of the supports 7,8 and emerge from the press seal 12. A lamp end cap 15 covers the end 2 of the lamp envelope 1 and carries two lamp pins 16, 17 that are insulated from each other in a conventional manner. The respective leads 13, 14 are connected to pins 16, 17. An external voltage is applied across the pair of pins 16, 17 and is consequently developed across the filament electrode 6 for heating the electrode and operating the lamp.

A cross-section of the structure shown in FIG. 1 is illustrated in FIG. 2. A mercury-containing capsule 20 is mounted on a side of the guard 9 opposite the filament electrode 6. From FIG. 2 it is apparent that if the filament electrode 6 were to break near the conductive support 8, the longer part connected to the conductive support 7 could fall against the guard 9 and possibly short circuit the voltage applied across the conductive supports 7, 8. Because the conductive support 8 is connected to the guard 9 by the fuse wire 11, any excessive current would necessarily flow through the fuse wire 11, and if the current rating is exceeded the fuse wire 11 will open. Of course, if the filament electrode 6 were to break so that a part of the filament connected to the support 8 were to touch the guard 9, no excess current condition would be created.

Figure 4:
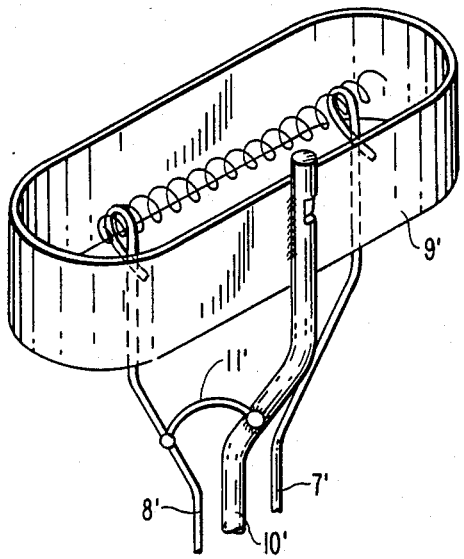
FIG. 4 is an isometric view of another embodiment of the electrode assembly according to the invention.

The isometric view of FIG. 3 clearly shows the spatial arrangement among the conductive electrode supports 7, 8 and the filament electrode 6, the guard 9 and guard support 10, and the fuse wire 11. In another embodiment of the invention shown in FIG. 4 the fuse wire 11 is connected between the electrode support 8' and the guard support 10'.

In operation, the voltage applied to the lamp pins 16, 17 heats the filament electrode 6 to promote thermionic emission of electrons. The potential difference between another electrode at an opposite end of the lamp (not shown) maintains an electrical discharge between the two electrodes. The electrical connection between the guard 9 and the filament electrode 6 established by the conductor 11 increases the effective area of the electrode when it is positively biased, and operating as an anode. This reduces the anode fall and consequently the power required for lamp operation.

Several lamps were made in order to determine what effect, if any, the electrical connection between the electrode 6 and the guard 9 has when the electrode is negatively biased as a cathode. The lamps were standard 40 watt cool white fluorescent lamps. Fourteen lamps were made according to the invention, with the conductor 11 connecting the electrode guard to the electrode support conductor. Additionally, fifteen control lamps without the conductor 11, but otherwise identical to the lamps according to the invention, were made for comparison purposes.

The lamps were operated on a representative commercial two-lamp rapid-start ballast. It was found that a pair of lamps according to the invention operating on the ballast consumed on the average 1.14 watts less than a pair of the control lamps operating on the ballast. To test the statistical significance of the data it was assumed that the average of the differences in power dissipation for each pair of lamps from the mean value followed the normal probably distribution. Based on this assumption, the 95% confidence interval for the difference in power consumption between a pair of lamps according to the invention and a pair of the control lamps was $\pm 1.01$ Watts and it is concluded that the data showing the lower power consumption of the invention is statistically significant. Thus, the lamp according to the invention dissipates about 0.57 watts less than the conventional lamp thereby establishing that whatever effect, if any, the connection between the electrode and the shield has during cathode operation of the electrodes, it is less than the improvement obtained during anode operation.

The connection of the fuse wire 11 to the conductive support and the electrode shield was done by spot welding. The fuse wire was 0.0035 inch diameter stainless steel wire. In order to establish its operability as a fuse, lamps were made with the fuse wire and an internal mechanism for shorting the electrode support to the electrode guard. In each instance with the electrode heater current flowing through the electrode, when the shorting mechanism was operated the fuse opened instantly and terminated the current flowing from the heater winding of the ballast.

What is claimed is:

1. In a fluorescent lamp having an electrode, conductive elements for supplying a voltage to said electrode, and a metallic guard partially surrounding said electrode for shielding material ejected from said electrode, the improvement comprising a metallic conductive link defining a conductive path free of rectifying elements between said metallic guard and one of said conductive elements supplying voltage to said electrode to maintain said metallic guard substantially at the same potential of said electrode irrespective of the polarity of the electrode voltage.

2. In a fluorescent lamp according to claim 1, wherein said metallic conductive link is a fuse effective to fuse and disconnect said metallic guard from said one of said conductive elements in response to an excessive current through said conductive link during lamp operation.

3. In a fluorescent lamp according to claim 1, wherein said metallic conductive link consists essentially of a length of wire connected between said metallic guard and said one of said conductive elements supplying voltage to said electrode.

4. In a fluorescent lamp according to claim 3, wherein said length of wire is 0.0035 inch diameter stainless steel wire and is effective to fuse and disconnect said metallic guard from said one of said conductive elements in response to an excessive current through said conductive link during lamp operation.

5. In a fluorescent lamp according to claim 1, the improvement further comprising a conductive guard support for supporting said guard positioned partially surrounding said electrode, and said metallic conductive link consisting essentially of a length of wire connected between said conductive guard support and said one of said conductive elements supplying voltage to said electrode.

6. In a fluorescent lamp according to claim 5, wherein said length of wire is 0.0035 inch diameter stainless steel wire and is effective to fuse and disconnect said metallic guard support from said one of said conductive elements in response to an excessive current through said conductive link during lamp operation.

7. In a fluorescent lamp having an electrode, first and second lead-in conductors connected to respective ends of said electrode to allow application of a potential across said electrode and thereby flow a heating current through said electrode, and a metallic guard partially surrounding said electrode, the improvement comprising: a metallic fuse link defining a conductive path between said metallic guard and said first lead-in conductor for maintaining said metallic guard at the same potential as said first lead-in conductor during normal lamp operation, said fuse link being effective to fuse and electrically disconnect said metallic guard from said first lead-in conductor in response to an excessive current through said fuse link.

8. In a fluorescent lamp according to claim 7, said metallic fuse link comprising a metal wire defining a conductive path free of rectifying elements between said metallic guard and said first lead-in conductor.

9. In a fluorescent lamp according to claim 7, a conductive guard support for supporting said guard positioned partially surrounding said electrode, and said metallic fuse link comprising a metal wire defining a conductive path free of rectifying elements between said conductive guard support and said first lead-in conductor.

10. In a fluorescent lamp having an electrode, first and second lead-in conductors connected to respective ends of said electrode to allow application of a potential across said electrode and thereby flow a heating current through said electrode, and a metallic guard partially surrounding said electrode, the improvement comprising: a metallic conductive link defining a conductive path free of rectifying elements between said metallic guard and said first lead-in conductor for maintaining said metallic guard at the same potential as said first lead-in conductor during normal lamp operation irrespective of the polarity of the electrode voltage.

11. In a fluorescent lamp according to claim 10, said metallic conductive link comprising a metal wire defining a conductive path free of rectifying elements between said metallic guard and said first lead-in conductor.

12. In a fluorescent lamp according to claim 11, wherein said metallic conductive link is a fuse effective to fuse and disconnect said metallic guard from said first lead-in conductor in response to an excessive current through said conductive link during lamp operation.

13. In a fluorescent lamp according to claim 10, a conductive guard support for supporting said guard positioned partially surrounding said electrode, and said metallic conductive link comprising a metal wire defining a conductive path free of rectifying elements between said conductive guard support and said first lead-in conductor.

14. In a fluorescent lamp according to claim 13, wherein said metallic conductive link is a fuse effective to fuse and disconnect said metallic guard support from said first lead-in conductor in response to an excessive current through said conductive link during lamp operation.

* * * * *